United States Patent [19]

Phelan

[11] Patent Number: 4,846,477

[45] Date of Patent: Jul. 11, 1989

[54] GOLF PUTTER

[76] Inventor: Herbert A. Phelan, 2543 W. Catalina, Phoenix, Ariz. 85017

[21] Appl. No.: 161,965

[22] Filed: Feb. 29, 1988

[51] Int. Cl.[4] ..... A63B 69/36; A63B 53/04

[52] U.S. Cl. ..... 273/175; 273/186 A

[58] Field of Search ..... 273/128 R, 175, 168, 273/164, 178, 162 R, 162 E, 186 A, 183 D, 193 R, 194 R, 194 A, 194 B, 167 J; D21/217, 218, 219

[56] References Cited

U.S. PATENT DOCUMENTS 1,846,412 2/1932 Weinberg ..... 273/129 W 3,881,733 5/1975 Csernits ..... 273/168

4,290,606 9/1981 Maxwell ..... 273/128 R 4,383,690 5/1983 Maxwell ..... 273/175

*Primary Examiner*—George J. Marlo

*Attorney, Agent, or Firm*—Harry M. Weiss

[57] ABSTRACT

A golf putter for improving the accuracy of putting is provided for putting a golf ball along a desired line of travel. The putter has a shaft, and a sleeve fixedly connected to the shaft, and a plate fixedly connected to the sleeve. The plate has an upper surface, a lower surface, a rear surface and a front surface. The front surface has a pair of vertical contact surfaces in the shape of a V-shaped groove. The vertical contact surfaces are disposed at equal angles of 30 degrees with a plane that passes through the center of gravity of the plate.

6 Claims, 1 Drawing Sheet

GOLF PUTTER

BACKGROUND OF THE INVENTION

1. Field of the Invention

The invention generally relates to a golf putter and method and, in particular, the invention relates to a golf putter and putter method wherein the putter has a groove with two contact surfaces for hitting a golf ball.

2. Description of the Related Art

Prior art golf putters is shown, for example, in U.S. Pat. Des. No. 162,054 issued Feb. 20, 1951 and Des. No. 163,083 issued May 1, 1951. Related U.S. patents include:

U.S. Pat. Des. No. 230,869 issued Mar. 19, 1974;
Des. No. 231,850 issued June 18, 1974;
Des. No. 233,454 issued Oct. 29, 1974;
Des. No. 236,736 issued Sept. 9, 1975;
Des. No. 239,454 issued Apr. 6, 1976;
Des. No. 247,382 issued Feb. 28, 1978;
Des. No. 248,050 issued May 30, 1978;
Des. No. 279,497 issued July 2, 1985; and
Des. No. 285,818 issued Sept. 23, 1986.

The above noted prior art golf putter includes a shaft, a sleeve fixedly connected to the shaft, and a plate or head fixedly connected to the sleeve. The plate has an elongate contact surface for contacting a golf ball.

One problem with the prior art golf putter is that there is no way to accurately center or direct the golf ball when applying a contact force to the golf ball.

SUMMARY OF THE INVENTION

According to the present invention, a golf putter is provided. The golf putter includes a shaft, a sleeve fixedly connected to the shaft, and a plate fixedly connected to the sleeve, wherein the plate has a pair of contact surfaces in the shape of a substantially V-shaped groove.

By using the pair of contact surfaces in the shape of a substantially V-shaped groove, the golf ball is centered in front of a selected part of the plate, where the two contact surfaces jointly contact the golf ball, whereby the problem of centering the golf ball is avoided.

The foregoing and other objects, features and advantages will be apparent from the following description of the preferred embodiments of the invention as illustrated in the accompanying drawings.

DESCRIPTION OF THE PREFERRED EMBODIMENTS

Figure 1:
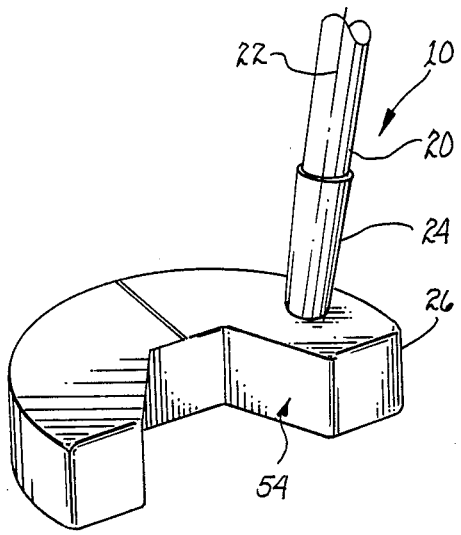
FIG. 1 is a perspective view of an embodiment of a golf putter according to the invention.
Figure 2:
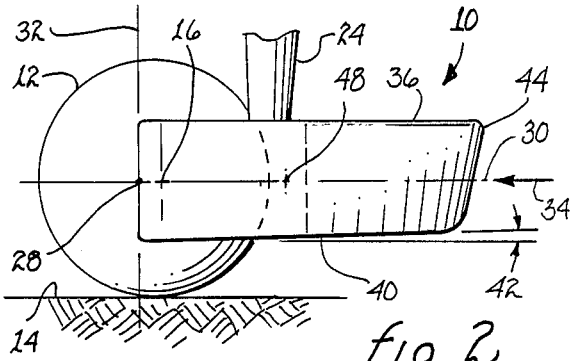
FIG. 2 is a side elevation view of the golf putter of FIG. 1.
Figure 3:
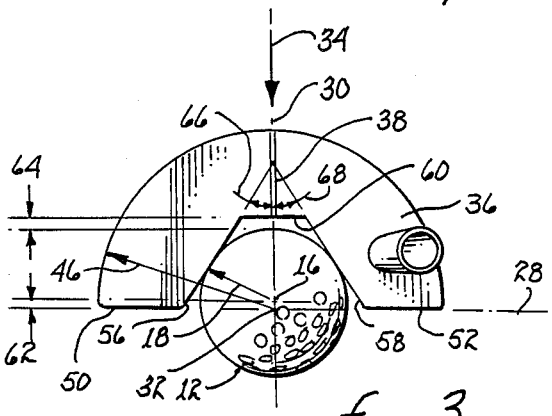
FIG. 3 is a plan view of the golf putter of FIG. 1.

As shown in FIGS. 1, 2 and 3, a golf putter 10 is provided. Putter 10 is arranged for hitting a golf ball 12 over the ground surface 14. Ball 12 has a spherical center or center of gravity 16 and has an outer radius 18.

Putter 10 includes a shaft 20 which has an axis 22, a sleeve 24 which is fixedly connected to shaft 20, and a plate or head 26 which is fixedly connected to sleeve 24. Shaft 20 is an elongate shaft which has a cylindrical cross section. Sleeve 24 has a shape of a frustrum of a cone. Sleeve 24 is a hollow sleeve which receives the end portion of shaft 20. Plate 26 has a horizontal x-axis 28, a horizontal y-axis 30 which is normal to x-axis 28, and a vertical z-axis 32 which is normal to a plane extending through x-axis 28 and y-axis 30. Axes 28, 30, 32 are reference axes for each of ilustration.

In FIGS. 1, 2 and 3, plate 26 has a desired direction of travel 34 which preferably is located in the plane of x-axis 28 and y-axis 30. The desired direction of travel 34 of plate 26 is achieved when a golfer putts a ball with accuracy. Direction 34 and y axis 30 are colinear.

Plate 26 also has an upper surface 36 which is flat and which is preferably in a plane normal to the z-axis 32. Upper surface 36 has a scribed line 38 which is preferably in a plane through the y-axis 30 and z-axis 32. Plate 26 also has a lower surface 40 which is inclined at a slight angle of inclination 42 relative to an adjacent plane which is normal to the z-axis 32. Plate 26 also has a rear surface 44, which has a frusto-conical shape. An upper edge of rear surface 44, where it meets upper surface 36, has a semi-circular shape and has a radius 46.

Plate 26 also has a center of gravity 48, which is approximately disposed in the plane that includes x-axis 28 and y-axis 30, assuming that the effect of sleeve 24 and shaft 20 is excluded.

Plate 26 also has a left front surface 50 and a right front surface 52 which are both in a plane that includes x-axis 28 and z-axis 32. Plate 26 also has a groove 54 which is disposed between surfaces 50, 52.

In FIG. 3, groove 54 has a left contact surface 56, and has a right contact surface 58, and has a middle non-contact surface 60. When ball 12 is in contact with both contact surfaces 56, 58, there is an offset 62 between ball center 16 and a plane including x-axis 28 and z-axis 32. There is also a clearance 64 between middle surface 60 and the adjacent surface of ball 12.

Left contact surface 56 intersects a plane through y-axis 30 and z-axis 32 at an angle 66 which is preferably about 30 degrees. Right contact surface 58 also intersects a plane through y-axis 30 and z-axis 32 at an angle 68 of about 30 degrees.

Figure 4:
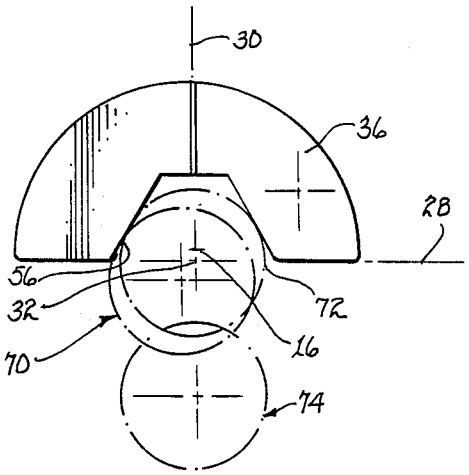
FIG. 4 is another plan view of the golf putter of FIG. 1 including a golf ball in three different positions.

In FIG. 4, ball 12 is shown in a first position 70, a second position 72, and a third position 74.

In operation and use, during a swing or forward movement of putter 10, as plate 26 contacts ball 12 in first position 70, ball 12 will then move along contact surface 56 to the second position 72, where ball 12 will contact both contact surfaes 56, 58. During the forward movement of plate 26 in the putting swing, ball 12 has applied thereto a normal force from each contact surface 56, 58. Each normal force has a forward component and a transverse component. The transverse components are equal and opposite, so that there is no transverse movement to ball 12. The forward components are equal and in the forward direction, so that there is a total forward force on ball 12. Ball 12 will then move along axis 30 and pass through position 74 in its forward movement.

Figure 5:
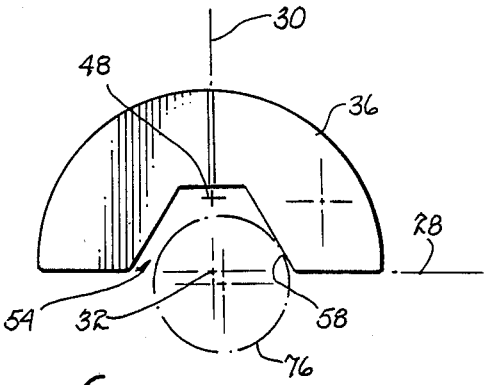
FIG. 5 is another plan view of the golf putter of FIG. 1 including a golf ball in a fourth position.

In FIG. 5, ball 12 is in a position 76, which is different than position 70 of FIG. 4. Position 76 is the alternate position of ball 12. During a swing, ball 12 will move along contact surface 58 to a position like position 72 (see FIG. 4), whereupon normal forces from surfaces 56, 58 will move ball 12 along axis 30 and pass through a position like position 74 in its forward movement.

Figure 6:
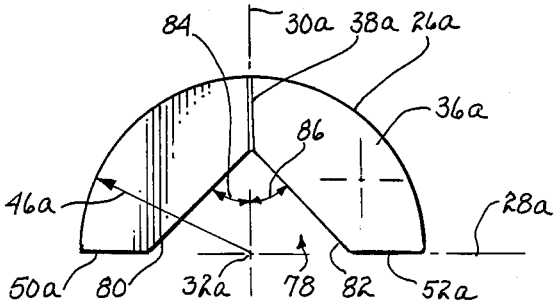
FIG. 6 is an alternate embodiment of a golf putter according to the invention.

As shown in FIG. 6, an alternate embodiment of a putter 10a according to the invention is provided. Parts of the embodiment of FIG. 6, which corresponds to parts of the embodiment of FIGS. 1 through 5, have the same numerals, but with a subscript "a" added thereto.

In FIG. 6, putter 10a has a plate 26*a* which has an x-axis 28*a*, a y-axis 30*a*, and a z-axis 32*a*. Plate 26*a* has an upper surface 36*a* with a scribe line 38*a*, which tells the line of the desired direction of travel. Plate 26*a* also has an edge radius 46*a*, a left front surface 50*a*, and a right front surface 52*a*. Plate 26*a* has a groove 78. Groove 78 has a left contact surface 80 and a right contact surface 82. Surface 80 intersects a plane including y-axis 30 and z-axis 32 at an angle 84, which is preferably about 30 degrees. Similarly, surface 82 intersects such plane at an angle 86, which is preferably also about 30 degrees.

One advantage of putter 10*a* over putter 10 is that the machine operation cutting or forming groove 78 are less difficult and accordingly less expensive than the machine operations for cutting or forming groove 54.

The advantages of putter 10 (and 10*a*) are described as follows:

1. A person striking ball 12 would be able to accurately direct the ball 12 in a linear direction along a line, which is in a plane bisecting the contact surfaces 56, 58 of groove 54.

2. If a person does not preferably hit ball 12, and if ball 12 is within the contact surfaces 56, 58 of groove 54, then ball 12 will travel in the selected direction.

3. Groove 54 permits a correction to ball 12, when ball 12 is struck inaccurately.

4. Contact surfaces 56, 58 of groove 54 provide two equal contact forces on ball 12, and their equal transverse force components cancel out, so that their equal forward force components are additive and are directed in the line of travel of plate 26, whereby ball 12 moves in a desired linear direction.

5. A person can direct ball 12 to a cup on a putting green, by assuring that the projection of scribe line 38, which is coplanar with a line bisecting the contact surfaces 56, 58 of groove 54, is aligned with the center of the cup.

6. Putter 10 (10*a*) is ideal as a teaching tool.

7. Putter 10 (10*a*), which is shown as a right hand putter, can be made opposite hand as a left hand putter.

8. With putter 10 (10*a*), a more exacting muscle memory or coordination is developed, by a repetition of a more precise stroke, which involves a more accurate coordination of eye, hand ball and putter, than that of the prior art putter.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A golf putter for hitting a golf ball comprising:

a shaft; and a plate fixedly connected to the shaft, the plate having a grooved front surface comprising a pair of opposite flat contact surfaces having an angle of substantially less than 90 degrees therebetween, said angle being bisected by a plane that includes the center of gravity of the plate.

2. The putter of claim 1, including a line formed on the upper surface of the plate and disposed in the plane bisecting the contact surfaces.

3. The putter of claim 1 wherein the plate itself has a center of gravity approximately disposed in the plane bisecting the contact surfaces.

4. The putter of claim 1, wherein the angle between the contact surfaces is substantially 60 degrees, and the plate has a middle surface disposed between the contact suffaces, said middle surface being symmetrical about the plane bisecting the pair of contact surfaces, said middle surface having a clearance from the golf ball when the golf ball is in contact with both said contact surfaces.

5. The putter of claim 1, wherein the angle between the contact surfaces is substantially 60 degrees.

6. The putter of claim 1, including a sleeve member fixedly connected to the shaft at one end thereof and fixedly connected to the plate at another end thereof.

* * * * *